United States Patent [19]

Bukaitz

[11] 4,232,920

[45] Nov. 11, 1980

[54] PREFABRICATED METAL DRAWER FILE CABINETS OR SIMILAR ARTICLES

[75] Inventor: Finley M. Bukaitz, Clifton, N.J.

[73] Assignee: Kero Metal Products Co., Inc., Carlstadt, N.J.

[21] Appl. No.: 46,451

[22] Filed: Jun. 7, 1979

[51] Int. Cl.[3] ..... A47B 87/00

[52] U.S. Cl. ..... 312/257 R; 312/257 SK; 312/257 SM; 312/107

[58] Field of Search ..... 312/257 R, 257 SK, 257 SM, 312/257 A, 107, 108

[56] References Cited

U.S. PATENT DOCUMENTS

| | | | |
|---|---|---|---|
| 1,627,084 | 5/1927 | Fritz | 312/107 |
| 2,514,631 | 7/1950 | Elvers | 312/107 |
| 2,667,401 | 1/1954 | Knuth | 312/257 R |
| 2,912,294 | 11/1959 | Wells et al. | 312/257 A |
| 3,110,535 | 11/1963 | Anderson | 312/257 SK |
| 3,294,276 | 12/1966 | Kemp et al. | 312/257 R |
| 3,480,345 | 11/1969 | Torok | 312/257 R |
| 4,040,694 | 8/1977 | Lascarrou | 312/257 SK |
| 4,077,686 | 3/1978 | Bukaitz | 312/257 SM |

FOREIGN PATENT DOCUMENTS

| | | | |
|---|---|---|---|
| 960363 | 6/1964 | United Kingdom | 312/257 SM |

*Primary Examiner*—Victor N. Sakran

*Attorney, Agent, or Firm*—Arthur L. Plevy

[57] ABSTRACT

There is disclosed a prefabricated file cabinet which employs a top and bottom rectangular pan member; each having side walls and a front wall having a depending flange emanating therefrom. The side walls of the module have two L shaped brackets secured thereto; which brackets support a drawer support frame member. The frame member consists of four channels forming a rectangular picture frame with a front and back channel of an L shaped configuration having two side channels with a C shaped configuration secured thereto. A prefabricated drawer consists of side assemblies; each of which has a bottom flange coupled to a C shaped slide flange. The drawer assembly is prefabricated and a front and back panel are secured to the side panels by means of flanges associated with each side panel. A bottom drawer assembly is inserted into bottom flanges also integral with the side panel and functions to secure the front and back panels thereto. The assembled drawer is inserted such that the bottom channels slide within the slide channels of the frame support. Stops are provided on the drawer sides to limit the movement of the drawers once positioned within the cabinet. The cabinet is entirely prefabricated using a plurality of sheet metal panels formed by simple stamping and bending techniques.

10 Claims, 21 Drawing Figures

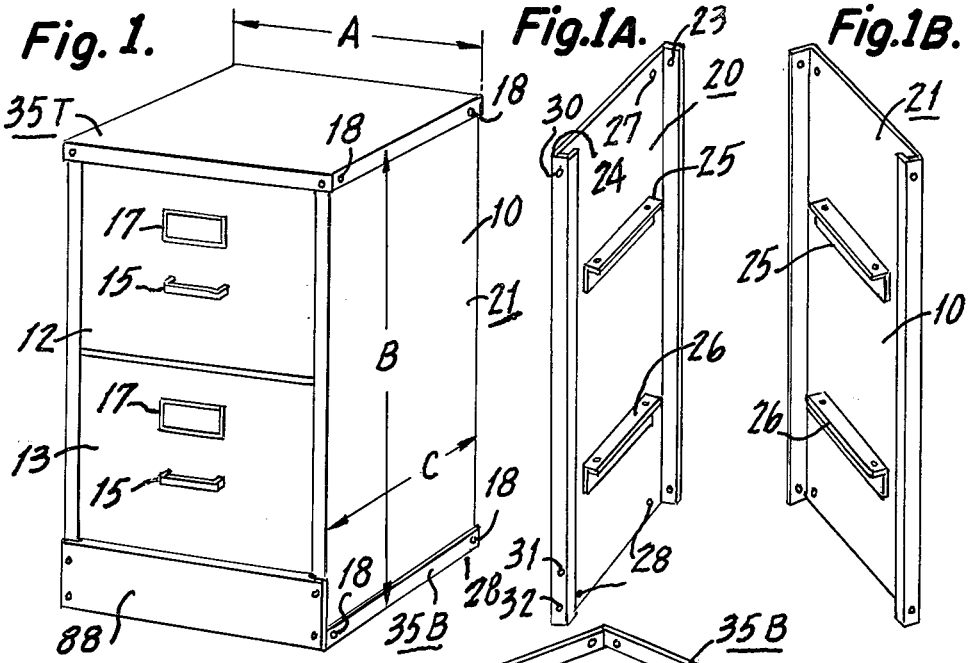
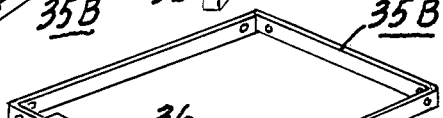
Fig.2.
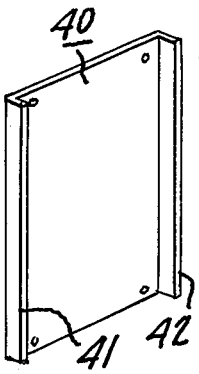
Fig.3.
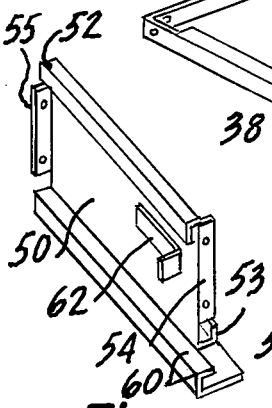
Fig.4A.
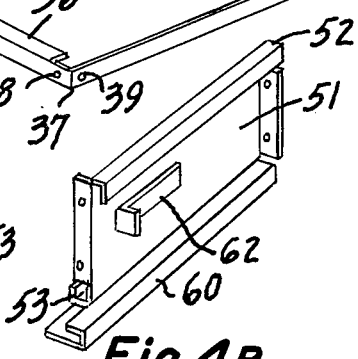
Fig.4B.
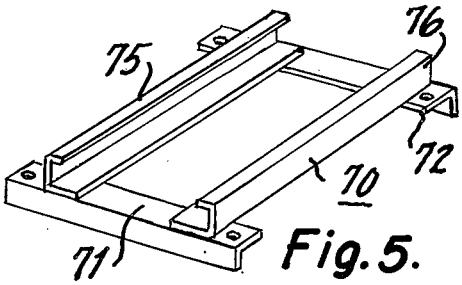
Fig.5.
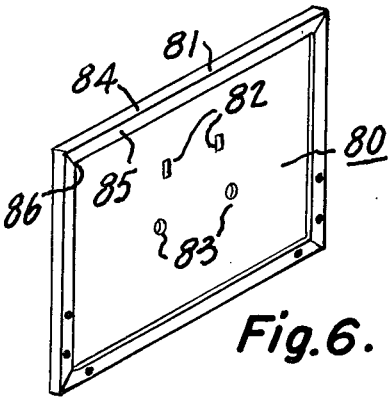
Fig.6.

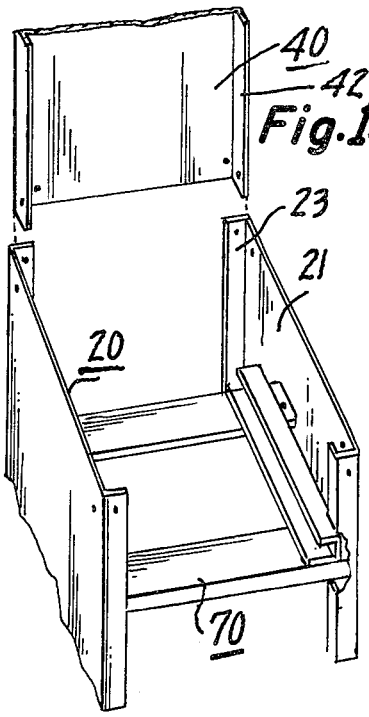
Fig.13.
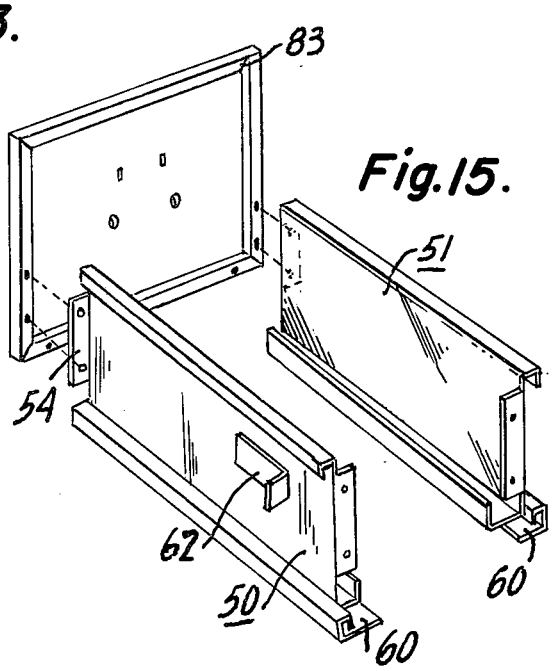
Fig.15.
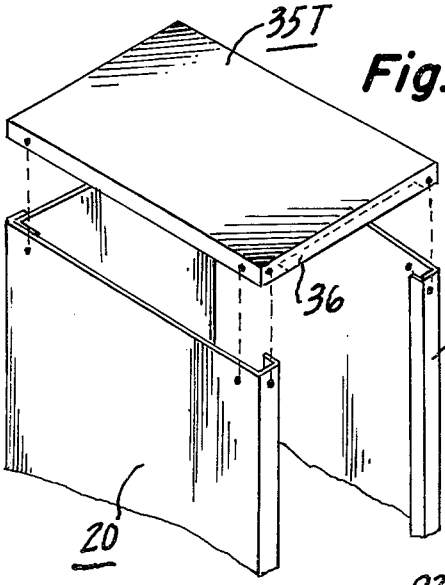
Fig.14.
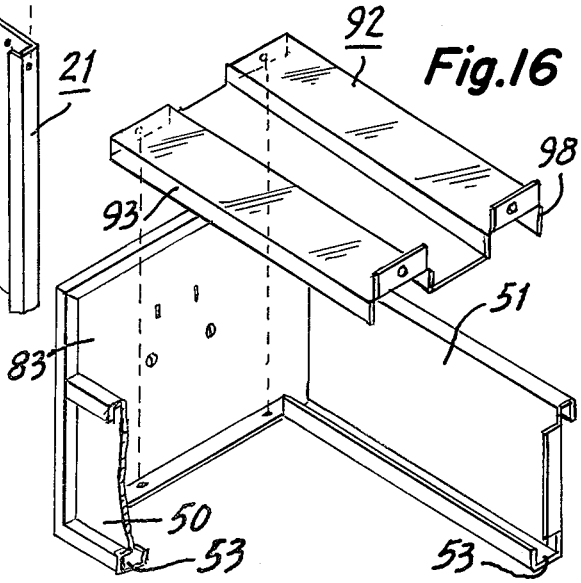
Fig.16
Fig.16A.
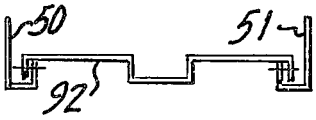

PREFABRICATED METAL DRAWER FILE CABINETS OR SIMILAR ARTICLES

BACKGROUND OF INVENTION

This invention relates to prefabricated cabinet assemblies and more particularly to a prefabricated metal drawer file assembly.

The prior art is replete with a number of patents and various devices relating to prefabricated structures in general. An example of a prefabricated assembly can be made by referring to U.S. Pat. No. 4,077,686 entitled PREFABRICATED METAL STORAGE CABINETS issued on Mar. 7, 1978 to Finley M. Bukaitz and assigned to the Assignee herein. Such cabinets as shown in the patent and others as well depict prefabricated units which can be employed in a home or office to provide storage use such as for coat closets, utility closets and other typical uses.

Many of the prior art prefabricated structures are fabricated from a relatively heavy corrugated cardboard or wood and are difficult to assemble and are not sufficiently strong for the purposes intended. Basically, a metal cabinet provides great strength and rigidity, while further providing a generally pleasing appearance. It is a prime factor in the fabrication of any unit that the parts necessary to fabricate the unit be as few in number as possible, be compact to enable efficient storage space at the selling location as well as in shipping or transporting.

A particular problem exists in the manufacture and assembly of any storage cabinet which employs drawers. Hence, most metal file cabinets are preassembled prior to shipment and therefore require large amounts of shipping and storage space. Certain storage cabinets are fabricated from cardboard and are prefabricated and shipped to a potential user in an unassembled configuration. These units are particularly deficient in the formation of the drawers and the storage capability.

A major problem in implementing a prefabricated file cabinet is the construction and operation of the drawers associated with such cabinets. As can be readily ascertained, the drawer assemblies must be strong and reliable and must be capable of accommodating relatively large weights associated with typical files and so on. There is therefore a need to provide an attractive file cabinet which can be easily assembled by a customer, while providing a strong structural capability with an attractive appearance. The unit must be capable of being quickly assembled with a minimum of effort. The drawer assemblies associated with the unit must be strong and reliable. It is, of course, understood that each panel arrangement or component part of the assembly must be relatively compact so that the same can be stored for sale in a relatively small package which will not unduly burden warehouses or storage space.

The unit to be described is a prefabricated file cabinet which is preferably constructed from a heavy gage furniture steel or metal which can be treated by an electrostatic baked enamel technique to provide a wide variety of colors for the consumer. Hence, the cabinet is both structurally sound, while possessing an attractive appearance.

BRIEF DESCRIPTION OF THE PREFERRED EMBODIMENT

A prefabricated drawer cabinet apparatus of the type having a closed bottom surface, a closed top surface, a back wall located between said top and bottom surfaces and first and second side walls relatively perpendicular to said back wall, with a front surface containing at least one drawer slideably mounted between said side walls for storage of suitable materials, comprising a top and a bottom box-like housing; each having two opposite side walls of equal length and height, and two additional side walls perpendicular to said opposite side walls, each of the same relative length and each of a height relatively equal to the height of said opposite side walls, said top and bottom housings each having a closed bottom surface and an open top surface, a right and a left side wall member each of the same dimensions and mirror images of each other, said side walls each having an "L" flange along one back side thereof and a "C" flange along the other front side thereof, said side walls being positioned between said top and bottom housings and coupled to said opposite side walls of said top and bottom housings to form a box-like member, with an open front and open back, each of said side walls having at least one support flange extending therefrom and located at the same distance from one of said top and bottom housings with said supporting flanges facing each other, a back planar panel covering said back opening, a drawer support frame assembly having first and second channel members extending between and located on said flanges between said side walls, and third and fourth cross channel members perpendicular to and secured to said first and second members to form a support frame assembly of a "picture frame"configuration, a drawer of a box-like configuration and having first and second sides; each of which has a bottom flange portion for sliding on said third and fourth cross channels, said drawer positioned on said support frame for withdrawl of the same from said front end opening of said box-like member.

BRIEF DESCRIPTION OF THE DRAWINGS

FIGS. 1A and 1B respectively show perspective plan views of left and right side assemblies.

FIG. 2 is a perspective plan view of a top and bottom pan assembly.

FIG. 3 is a perspective view of a back assembly.

FIGS. 4A and 4B are respectively perspective plan views of a drawer side assembly.

FIG. 5 is a perspective plan view of a drawer support frame assembly.

FIG. 6 is a perspective rear view of a front drawer panel.

FIG. 13 is a partial assembly view showing the coupling of a back panel to the cabinet.

FIG. 14 is a partial assembly view showing the coupling of a top pan panel to the cabinet assembly.

FIG. 15 is a partial assembly view showing the coupling of the front drawer panel to the drawer side panels.

FIG. 16 is a partial assembly view showing the coupling of the bottom drawer panel to the drawer side panels and front panel.

DETAILED DESCRIPTION OF THE INVENTION

Figure 7:
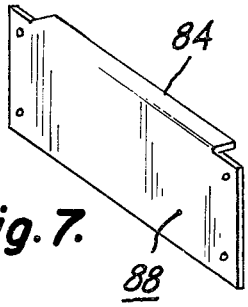
FIG. 7 is a perspective view of a front bottom cabinet panel.

There is shown a prefabricated two drawer file cabinet 10. Essentially, the file cabinet 10 has a typical appearance and thusly appears as a conventional unit. As will be explained, the unit 10 is fabricated from a number of preformed pieces which are conveniently packaged and shipped requiring a very small storage area. Each piece of the cabinet assembly is prefabricated by a simple stamping and bending process and each panel or component part, as will be described, is fabricated from steel sheet of suitable gage.

The basic cabinet has approximately the following dimensions: Dimension A is approximately 14", dimension B is approximately 28", while dimension C is approximately 17". It is, of course, understood that these dimensions are representative only and various other dimensions can be accommodated without departing from the scope and intent of the patent.

As shown in FIG. 1, the file cabinet includes two drawers 12 and 13; each having an appropriate handle as 15 and 16 and each having a label holder as 17 and 18.

The various parts of the cabinet 10 are secured together by means of bolts as 18 which are emplaced in apertures preformed into each panel during the fabrication process.

In order to clearly describe the operation and assembly of the structure and to distinctly point out the unique advantages concerning the drawer construction and associated apparatus, reference will be had to the following drawings. The first series of drawings designate each component part necessary for construction of the cabinet assembly, while the second series of drawings show the fabrication of the cabinet assembly in a step by step procedure as employing the component parts depicted in the first series of drawings.

Referring to FIGS. 1A and 1B, there is shown respectively a left side panel 20 and a right side panel 21. As can be seen, each panel has a first flange 23 of an L shaped configuration and a front flange 24 of a C shaped configuration. Secured to each panel and spot welded in a predetermined position are L shaped brackets 25 and 26 which are employed for supporting a drawer support frame assembly. Each L shaped bracket is spot welded between channels 23 and 24 on the inner surface of the respective side panel as 20 and 21. Each side panel has two apertures 27 near the top surface thereof and two apertures 28 near the bottom surface thereof. Each L shaped bracket as 25 and 26 also has a first and second aperture near each end. The side panels have a top aperture 30 on the front bracket 24 and two apertures 31 and 32 near the bottom of the front bracket. There is also an aperture near the top of bracket 23 and an aperture near the bottom of bracket 23.

As can be ascertained from FIGS. 1A and 1B and as indicated, the side panels are fabricated from a 24 gage (0.24") cold rolled steel stock. The various apertures shown in the panel are predrilled and the single sheet is bent to form the back upstanding or L shaped bracket 23 and the front C shaped bracket 24.

It is understood that the terms L and C are used with respect to the back surface of the panel which is the major surface area of the same. The L shaped brackets 25 and 26 are also fabricated from a suitable gage steel (20 gage - (0.35") and are then spot welded or otherwise secured to the inner sides of the side panels 20 and 21.

Referring to FIG. 2, there is shown a top and a bottom pan assembly 35. Basically, the assembly 35 is a box-like member having side walls of the same height with a front wall further comprising a right angle flange 36. At the juncture of each side wall such as 37, two apertures as 38 and 39 are preformed therein. The panel assembly 35, as can be ascertained from FIG. 1, comprises the top and bottom surfaces for the file cabinet.

Essentially, the top and bottom panel configuration 35 is fabricated from a single piece of precut steel (24 gage) which is bent by a conventional bending machine. It is noted that the top and bottom pan assemblies as 35 are identical in configuration.

Shown in FIG. 3 is a back panel assembly 40. Essentially, the back panel consists of a single sheet of steel material (26 gage - (0.18") steel which has a front and back L shaped flange 41 and 42. A cross-section of the back panel assembly is shown in FIG. 3A.

As one can see thusfar, the sides, top and bottom and back assemblies are extremely simple, compact and easy to fabricate.

Referring to FIGS. 4A and 4B, there are shown a right (FIG. 4A) and a left (FIG. 4B) drawer side assembly. It is noted, of course, that for two drawers, one requires two right assemblies as 50 and two left assemblies as 51. The major portion of the drawer assemblies are fabricated from a single sheet of steel material. Each drawer side has a top C shaped bracket 52 which is bent outwardly. Each drawer has a larger bottom C shaped channel which is bent inwardly or in the opposite direction from channel 52. The front of the drawer side assembly has an L shaped flange 54 directed inwardly, while the rear of the assembly has an L shaped flange 55 directed outwardly. It is noted that each flange as 54 and 55 are perpendicular to the main surface of the side assembly. Each side assembly is spot welded to a J channel 60. Channel 60 is again formed from a single sheet of steel material and is secured to the bottom flange 53 by a spot welding or other technique. Located on the outer side of each drawer is a stop assembly 62 which basically is a single sheet of steel material with a front tapered configuration and operates to prevent the drawer from being pulled out of the cabinet. Such stop assemblies are also prewelded at suitable locations on the respective sides of the drawer side members 50 and 51.

Shown in FIG. 5 is a drawer support assembly 70. Essentially, the assembly 70 shown in FIG. 5 consists of a frame. The frame includes a first bracket 71 which is adapted to extend between brackets 25 of the side panels 20 and 21. A back L shaped bracket 72 is of an identical configuration and is parallel to bracket 71 and is also of an L shaped configuration. Perpendicular to and joining brackets 71 and 72 together are J shaped slide channels 75 and 76. The channels 75 and 76 are fabricated from a single sheet of steel material and are bent into a J configuration and are then spot welded or secured to channels or brackets 71 and 72. This frame assembly provides a strong support surface for each drawer, while further serving as a structural support member for the entire cabinet assembly.

It is, of course, noted that in regard to the above described components, each has corresponding apertures on certain portions thereof which are clearly shown in the drawings and which will be further located in regard to the series of construction drawings to follow. Hence, in order to avoid the utilization of many confusing reference numerals, the apertures are shown but have not been designated by such numerals.

Referring to FIG. 6, there is shown a rear view of a drawer front assembly 80. Essentially, the assembly has a flat front surface 81 which has two slots 82 adapted to hold or coact with a label holder and two apertures as 83 adapted to accommodate a handle assembly. Each side of the drawer assembly consists of a first flange 84 which is formed by a bending process and a second downwardly or perpendicular flange 85 which has an angled side shape 86 to provide a frame configuration on the inner surface of the drawer as depicted in FIG. 6. This construction provides rigidity and an aesthetic appearance as well. There are apertures in the drawer assembly at suitable locations as shown to enable securing of the drawer front assembly 80 to the drawer side assemblies 50 and 51.

Shown in FIG. 7 is a front bottom assembly 88. Essentially, the front bottom assembly consists of a single piece of gage steel which has a top flange 84 of an L shaped configuration. The flange 84 is centrally located leaving an equal area on each side thereof. The front bottom assembly is shown in FIG. 1 and provides a front surface to allow for the appropriate spacing of drawer 13 above a floor or other surface upon which the cabinet is located.

Figure 8:
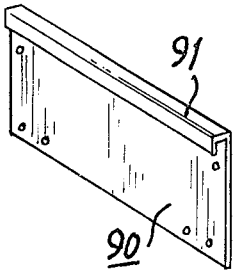
FIG. 8 is a perspective plan view of a drawer back panel.

Referring to FIG. 8, there is shown a drawer back assembly 90. The assembly 90 is used to form the back surface of the drawer and basically is a single sheet of steel formed with a bent C shaped flange 91 on the top surface.

Figure 9A:
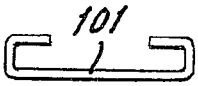
FIG. 9A is a side view of a follower slide channel.
Figure 9:
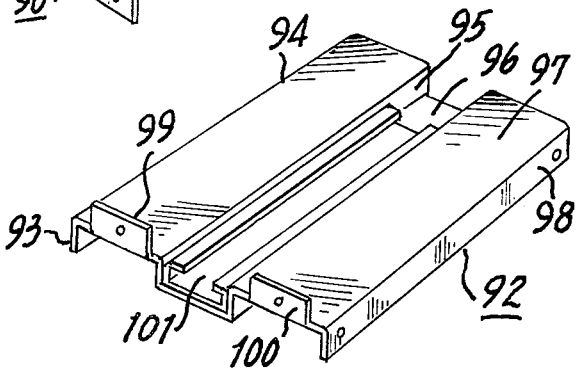
FIG. 9 is a perspective view of a drawer bottom panel.

Shown in FIG. 9 is a drawer bottom assembly 92. Assembly 92 consists of a single sheet of steel material which is bent as shown in the drawings. The drawer bottom assembly 92 has a side flange 93 at right angles to a left top portion 94. The portion 94 extends in a horizontal plane where a downward bend 95 occurs at right angles to a central flat section 96. Another bend forms a left flat portion 97 which terminates in a downward flange 98. Sections 94 and 98 of the drawer bottom assembly 92 have upward extending flanges 99 and 100 formed thereon. The central recessed portion of the drawer 96 includes a spotwelded follower block channel 101.

Figure 10:
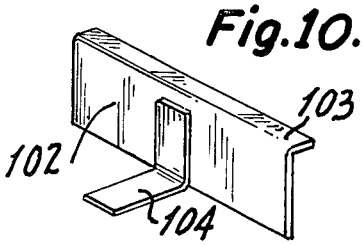
FIG. 10 is a perspective view of a follower block assembly.

A cross section of channel 101 is shown in FIG. 9A. The purpose of the channel 101 is to accommodate a follower block assembly as depicted in FIG. 10. The follower block assembly basically comprises a single sheet of steel material 102 having a top flange 103. Welded to the center of the block assembly 102 is an L shaped bracket 104. The bottom arm of bracket 104 is adapted to be inserted into channel 101 and is positioned on the inside of the assembled drawer. The function of the block assembly 102 is to enable a user of the cabinet to position the same against files or papers which are stored in the drawer. The operation of such follower block assemblies as 102 is well known in the art.

Figure 11:
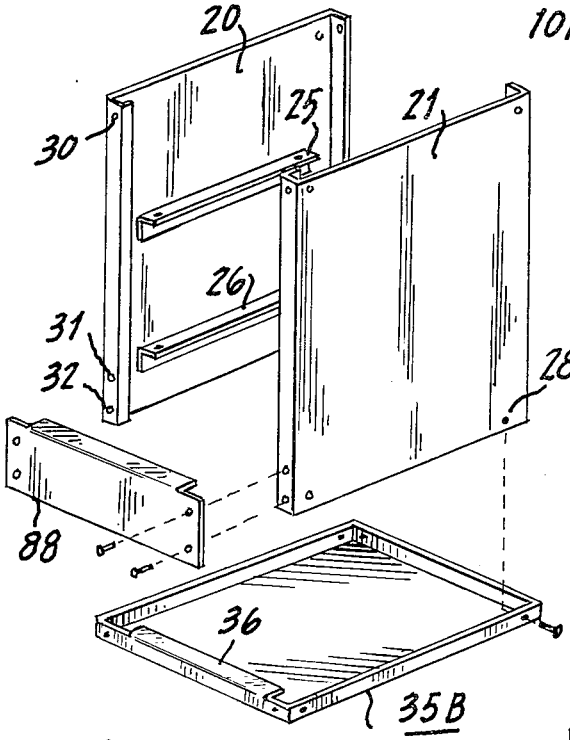
FIG. 11 is an assembly view depicting the coupling of the side panels to a bottom pan.

Referring to FIG. 11, there is shown as assembly drawing indicating the manner in which the various component parts described above are assembled together. In FIG. 11, the left side panel 20 (FIG. 1A) and the right side panel 21 (FIG. 1B) are shown positioned above the bottom pan assembly 35 as depicted in FIG. 2. The panels are inserted as indicated by the dashed lines so that the front flange 30 fits in the space between the flange 36 of the bottom pan 35. The apertures in the sides of the panels as 28 automatically align with the apertures in the bottom pan and bolts or screw assemblies are inserted to secure the side panels 20 and 21 to the bottom pan 35. The front panel 88 as shown in FIG. 7 is then secured to the apertures 31 and 32 in the side panel assemblies 20 and 21.

Figure 12:
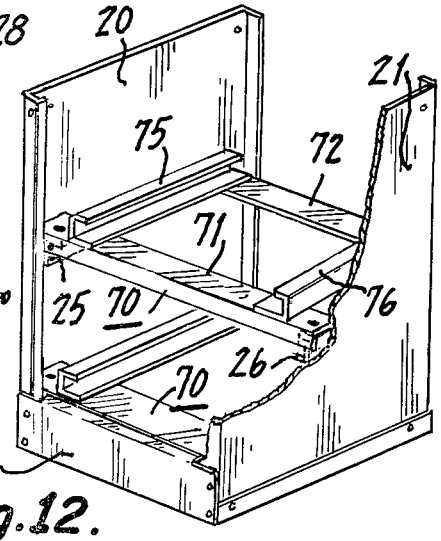
FIG. 12 is a partial assembly view showing the coupling of the drawer frame panels to the side panels.

Referring to FIG. 12, the next procedure is emplacing the drawer support frames on the flanges 25 and 26 associated with each panel. For the sake of clarity, panel 21 has been broken with its corresponding flange 25 shown. The frame members 70 of FIG. 5 are emplaced upon the side flanges 25 and 26 and are bolted via the apertures in the front rails 71 and 72 of the support assemblies 70.

Referring to FIG. 13, the back panel 40 shown in partial view (FIG. 3) is slid into position between the side panels 20 and 21 with the flanges 42 inserted within the flanges 23 on the side panels 20 and 21. The apertures in the back panel align with the apertures on the back side surface of the pan 35 and are secured thereto.

Referring to FIG. 14, the assembly thus depicted now has secured thereto a top pan which is of the same configuration as the bottom pan 35 and for example, as shown in FIG. 2. The flange 36 is shown in dashed configuration and is located on the inner section of the top panel 35T. As is shown in FIG. 14, the top panel is then secured to the side panel via the holes in the side panel and the top panel which as indicated, is prestamped to align properly.

Referring to FIG. 15, there is shown the drawer front panel 83 (FIG. 6) adjacent the right side member 50 and the left side member 51 as shown in FIGS. 4A and 4B. The side panels together with the appropriate slide channels are secured to the apertures on the door flange via the end flanges 54. This is done by sheet metal screws or other similar fastening devices as depicted in the drawings.

Referring to FIG. 16, the bottom assembly 92 of FIG. 9 is then inserted between the side panels 50 and 51 with the outer flanges 93 and 98 of the drawer bottom 92 disposed between the flanges 53 of the drawer sides.

FIG. 16A shows a line drawing of the structure.

Figure 17:
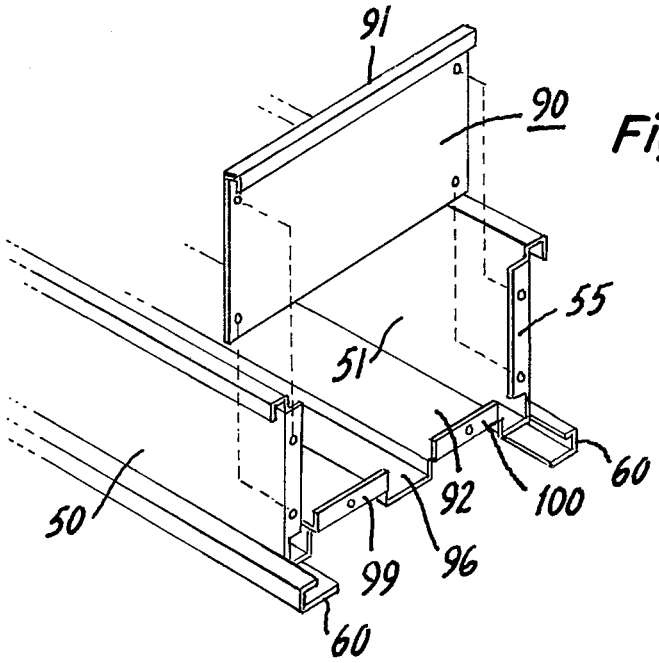
FIG. 17 is a partial assembly view showing the coupling of the rear drawer panel to the drawer sides and bottom panels.

Referring to FIG. 17, the back drawer panel 90 of FIG. 8 is then secured to the back flanges 55 of the drawer sides and to the upstanding flanges 99 and 100 of the drawer bottom 92.

Figure 18:
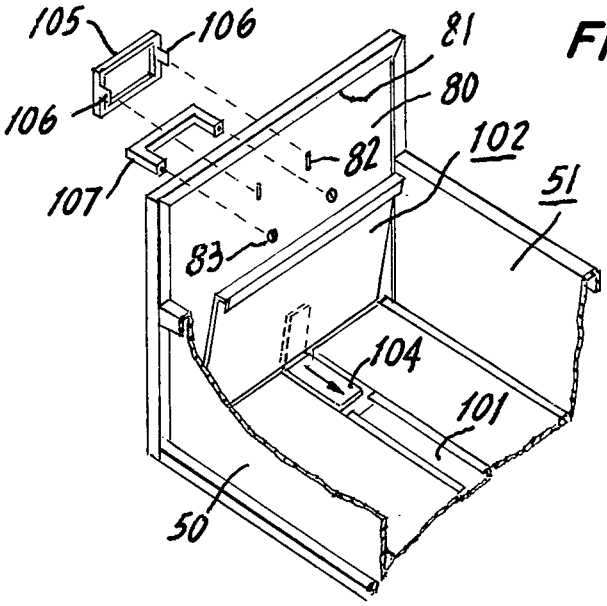
FIG. 18 is a partial assembly view showing location of the follower block within a follower slide channel.

As shown in FIG. 18, the follower block 102 is then placed in the follower block channel 101. This completes the fabrication of the drawer. A label holder 105 is shown and is fabricated from a metal frame having two tabs 106 located thereon. The tabs are inserted via the slot 82 on the front drawer panel 80. A handle 107 having two apertures is also emplaced using the holes 83 on the drawer front 80 to thus complete the final construction of the drawer.

As can be seen, the drawers are positioned on the drawer support frames 70 with the bottom channel 60 of the drawers sliding or riding upon the channels 75 and 76 of the drawer support frame 70. The cross channels 71 and 72 offer a beam support for the drawer assemblies which are further strengthened by the particular sliding channels as 75 and 76 associated with the frame support 70. In this manner, the prefabricated drawers are capable of supporting great weights.

It is noted that each individual piece as shown in FIGS. 1–10 is formed from single sheet material only employing perpendicular bends to produce the various flanges and sides and hence, the entire structure is extremely easy to manufacture. The exception to this is the spot welding of the brackets 25 and 26 in the side walls. Spot welding is an extremely simple operation and it is further noted that the brackets as 25 and 26 are L shaped brackets fabricated from single sheet metals. Spot welding is also employed to secure the bottom channel 60 to the drawer sides 51 and 52 and to secure the drawer slide channels 75 and 76 to the support rails 71 and 72. It is noted that any other suitable technique may be employed in lieu of spot welding and hence, the above described components could be secured to the respective units by means of rivets, bolts, screws and other known fastening devices.

Thus, there has been shown a simple prefabricated file cabinet which can be easily fabricated and assembled to provide an attractive module. The individual components of the module are all relatively rectangular in configuration and are extremely thin as in most instances, the outstanding flanges are relatively of the same dimension. Hence, the entire assembly can be packaged in a compact box or container for easy shipment and storage. The support frames 70 for the drawers as emplaced upon the side flanges 25 and 26 assure a strong structural unit while enabling the associated prefabricated drawer assemblies to support a great deal of weight.

It would also be apparent to one skilled in the art that various other configurations could be implemented by employing the modular sections depicted herein.

A major advantage of the structure shown is the accommodation of slideable drawer assemblies; all of which are prefabricated.

I claim:

1. A prefabricated drawer cabinet apparatus of the type having a closed bottom surface, a closed top surface, a back wall located between said top and bottom surfaces and first and second side walls relatively perpendicular to said back wall, with a front surface containing at least one drawer slideably mounted between said side walls for storage of suitable materials, comprising:

(a) a top and a bottom box-like housing; each having two opposite side walls of equal length and height, and two additional side walls perpendicular to said opposite side walls, each of the same relative length and each of a height relatively equal to the height of said opposite side walls, said top and bottom housings each having a closed bottom surface and an open top surface, (b) a right and a left side wall member, each of the same dimensions and mirror images of each other, said side walls each having an "L" flange along one back side thereof and a "C" flange along the other front side thereof, said side walls being positioned between said top and bottom housings and coupled to said opposite side walls of said top and bottom housings to form a box-like member, with an open front and open back, each of said side walls having at least one support flange extending therefrom and located at the same distance from one of said top and bottom housings with said supporting flanges facing each other, (c) a back planar panel covering said back opening, (d) a drawer support frame assembly having first and second channel members extending between and located on said flanges between said side walls, and third and fourth cross channel members perpendicular to and secured to said first and second members to form a support frame assembly of a "picture frame" configuration, (e) a drawer of a box-like configuration and having first and second sides; each of which has a bottom flange portion for sliding on said third and fourth cross channels, said drawer positioned on said support frame for withdrawl of the same from said front end opening of said box-like member.

2. The cabinet apparatus according to claim 1 wherein said back panel has two perpendicular flanges at each side, with said flanges inserted within said "L" shaped flanges associated with said side walls.

3. The cabinet apparatus according to claim 1 wherein said support flanges each comprise an "L" shaped bracket with one leg of said "L" secured to said side wall and said other leg extending therefrom to form said support flange.

4. The cabinet apparatus according to claim 1 wherein said support frame assembly has said first and second channel members of an "L" shaped cross section, with said third and fourth channel members having a central portion perpendicular to said first and second channels with a bottom flange extending from and secured to said first and second channel members with said bottom flanges of said cross channel members facing each other, and a top flange of a narrower width than said bottom flange emanating from said central portion with said top flange of said channel members also facing each other, with said third and fourth cross channels secured to said first and second channels at a predetermined distance from the ends thereof.

5. The cabinet apparatus according to claim 1 wherein said drawer is prefabricated and comprises:

(a) first and second side panels, each having a bottom channel above said bottom flange portion, (b) a front panel secured to said side panels at one end, (c) a rear panel secured to said side panels at said other end, (d) a bottom panel having a central recess and having a flange at each side for coacting with said bottom channels of said side panels, to be retained therein.

6. The apparatus according to claim 1 wherein said top and bottom housings are fabricated from an integral sheet of metal.

7. The apparatus according to claim 5 further including a slideable follower block located on said central recess of said bottom panel and adapted to slide with respect to said drawer.

8. The apparatus according to claim 5 wherein said side panels each have a front flange for coupling to said front panel and a rear flange for coupling to said rear panel with said front flange directed opposite to said rear flange.

9. The apparatus according to claim 5 wherein said front panel has two slots on a front planar surface thereof and adapted to receive a label holder frame whereby the contents of said drawer can be indicated.

10. The cabinet apparatus according to claim 1 wherein each of said top and bottom housings, said right and left side walls, said back panel, said drawer support frame and said drawer are fabricated from steel sheet material of a relatively thin gage with said associated flanges being integrally formed therewith by a bending technique.

* * * * *